US010890045B2

(12) United States Patent
Chenault et al.

(10) Patent No.: US 10,890,045 B2
(45) Date of Patent: Jan. 12, 2021

(54) PLUGS FOR ISOLATING PORTIONS OF WELLBORES

(71) Applicant: Cerca Downhole Technologies LLC, Sanger, TX (US)

(72) Inventors: Graham Chenault, Krum, TX (US); Kelly Kykkanen, Sylvan Lake (CA); Anthony Honke, Red Deer (CA); Tanner Ingram-Johnson, Red Deer (CA); Kenneth Stokley, Victoria, TX (US)

(73) Assignee: Cerca Downhole Technologies LLC, Sanger, TX (US)

( * ) Notice: Subject to any disclaimer, the term of this patent is extended or adjusted under 35 U.S.C. 154(b) by 10 days.

(21) Appl. No.: 16/261,266

(22) Filed: Jan. 29, 2019

(65) Prior Publication Data

US 2020/0240233 A1 Jul. 30, 2020

(51) Int. Cl.
*E21B 33/128* (2006.01)
*E21B 33/129* (2006.01)
(Continued)

(52) U.S. Cl.
CPC ..... *E21B 33/128* (2013.01); *E21B 23/06* (2013.01); *E21B 33/126* (2013.01);
(Continued)

(58) Field of Classification Search
CPC .... E21B 33/08; E21B 33/126; E21B 33/1265; E21B 33/128; E21B 33/129; E21B 33/1208
(Continued)

(56) References Cited

U.S. PATENT DOCUMENTS 1,860,467 A * 5/1932 Mack ..... E21B 33/1293 166/119
3,186,489 A * 6/1965 Farrar ..... E21B 33/1291 166/138
(Continued)

FOREIGN PATENT DOCUMENTS

WO 20170151384 9/2017

OTHER PUBLICATIONS

"Boss Hog Frac Plugs", Downhole Technology, 2015, 6 pgs.
(Continued)

*Primary Examiner* — Robert E Fuller
(74) *Attorney, Agent, or Firm* — Henry Patent Law Firm PLLC

(57) ABSTRACT

A plug includes a tubular conduit having a first end and a second end. The plug also includes a cap disposed over the first end of the tubular conduit and coupled thereto. The cap is configured to mate with a wireline adapter kit of a perforating string. The plug additionally includes a guide shoe disposed over the second end of the tubular conduit and coupled thereto. The guide shoe is configured to move along the tubular conduit from an unset position, away from cap, to a set position, toward the cap. A gripping assembly is disposed around the tubular conduit between the cap and the guide shoe and coupled to the guide shoe. A sealing assembly is disposed between the cap and the gripping assembly. The sealing assembly includes a first sealing band and a second sealing band. The first sealing band is disposed around the tubular conduit and has an annular lip.

24 Claims, 5 Drawing Sheets

(51) Int. Cl.

| | |
|---|---|
| ***E21B 33/126*** | (2006.01) |
| ***E21B 33/12*** | (2006.01) |
| ***E21B 23/06*** | (2006.01) |
| *E21B 43/26* | (2006.01) |

(52) U.S. Cl.
CPC ..... *E21B 33/1208* (2013.01); *E21B 33/1291* (2013.01); *E21B 43/26* (2013.01)

(58) Field of Classification Search
USPC ..... 277/335, 340, 342
See application file for complete search history.

(56) References Cited

U.S. PATENT DOCUMENTS

| | | | | |
|---|---|---|---|---|
| 3,265,132 | A * | 8/1966 | Edwards, Jr. ..... | E21B 33/1295 166/120 |
| 4,730,835 | A * | 3/1988 | Wilcox ..... | F16J 15/166 166/120 |
| 8,336,616 | B1 | 12/2012 | McClinton | |
| 8,887,818 | B1 | 11/2014 | Carr et al. | |
| 9,016,364 | B2 | 4/2015 | Chenault et al. | |
| 2011/0315403 | A1 | 12/2011 | Nard et al. | |
| 2012/0125637 | A1 | 5/2012 | Chenault et al. | |
| 2015/0247375 | A1 | 9/2015 | Stout | |
| 2016/0305215 | A1 | 10/2016 | Harris et al. | |
| 2017/0130553 | A1 | 5/2017 | Harris et al. | |
| 2019/0145219 | A1* | 5/2019 | Saraya ..... | E21B 34/102 166/373 |

OTHER PUBLICATIONS

"Diamondback Composite frac plug", Schlumberger, 2018, 2 pgs.
"Diamondback SL Short-length composite frac plug", Schlumberger, 2018, 2 pgs.
"Fas Drill(R) Frac Plug", Halliburton, Jul. 2014, 3 pgs.
"Fas Drill(R) Ultra Frac Plug", Halliburton, Jun. 2017, 1 pg.
"Halliburton 250-Series Frac Plugs", Halliburton, Sep. 2012, 3 pgs.
"M1 Frac Plug", Yellow Jacket Oil Tools, obtained on or before Nov. 2018, 2 pgs.
"Minima(TM) Composite Frac Plug", Weatherford, 2018, 1 pg.
"Obsidian(R) Frac Plug", Halliburton, Feb. 2018, 2 pgs.
"Obsidian(R) Prime Frac Plug", Halliburton, May 2018, 1 pg.
"ProDrill(R) Express Series Composite Plugs", Forum Energy Technologies, Sep. 2017, 2 pgs.
"ProDrill(R) Velocity(TM) Fast-Drillout Composite Plug", Forum Energy Technologies, Sep. 2017, 2 pgs.
"Product Catalog", retrieved from http://www.silver-fox.net/files/2315/2763/1649/Product_Catalog_v1805.pdf on Nov. 15, 2018, 68 pgs.
"PS-X All-Composite Frac Plug", https://www.repeatprecision.com/wp-content/uploads/2018/10/PS-X-1.jpg, 2018, 3 pgs.
"PurpleSeal Composite Frac Plugs", Repeat Precision;, obtained on or before Nov. 2018, 3 pgs.
"Rapid Mill (TM) Composite Frac Plugs", Magnum Oil Tools International, Jan. 22, 2018, 2 pgs.
"Real Success: RzrFRAC(TM) Composite Frac Plug", Rubicon Oilfield International, Sep. 26, 2017.
"Scorpion Composite Plug", Maverick Oil Tools; Midland, Texas, obtained on or before Nov. 2018, 1 pg.
"ShortSTAK(TM) Composite Frac Plug", C&J Energy Services; PetroFrac Energy Services, LLC, 2018, 2 pgs.
"Tomcat(TM) Hybrid Frac Plug", Innovex Downhole Solutions, obtained on or before Nov. 2018, 1 pg.
"Trident Series Total Composite Fracturing Plug", Gryphon Oilfield Solutions, obtained on or before Nov. 2018, 1 pg.
"Trident Series X Composite Fracturing Plug", Gryphon Oilfield Solutions, obtained on or before Nov. 2018, 1 pg.
"Tru-Mill(TM) Composite Plug", C&J Energy Services, 2018, 2 pgs.
"Ultron Frac Plug", Tartan Completions, obtained on or before Nov. 2018, 9 pgs.

* cited by examiner

PLUGS FOR ISOLATING PORTIONS OF WELLBORES

BACKGROUND

The following description relates to tools for wellbores, and more particularly, plugs for isolating portions of wellbores.

Wellbores are commonly drilled to reach fluids that reside underground, such as hydrocarbon fluids within a reservoir formation. A wellbore may be reinforced with steel or concrete pipe segments, often referred to as encasements, to provide structural integrity to the wellbore. A wellbore may also be partitioned into two portions using a plug, which is capable of isolating an upstream portion from a downstream portion. The plug may allow wellbore processing operations (e.g., fracturing operations) to occur in the upstream portion without significantly affecting the downstream portion (or vice versa).

SUMMARY

Plugs for isolating a portion of a wellbore are disclosed herein. For example, a plug may include a tubular conduit having a first end and a second end. The plug also includes a cap disposed over the first end of the tubular conduit and coupled thereto. The cap is configured to mate with a wireline adapter kit of a perforating string. The plug additionally includes a guide shoe disposed over the second end of the tubular conduit and coupled thereto. The guide shoe is configured to move along the tubular conduit from an unset position, away from cap, to a set position, toward the cap. A gripping assembly is disposed around the tubular conduit between the cap and the guide shoe and coupled to the guide shoe. A sealing assembly is disposed between the cap and the gripping assembly. The sealing assembly includes a first sealing band and a second sealing band. The first sealing band is disposed around the tubular conduit and has an annular lip. Methods for isolating a portion of a wellbore are also disclosed.

DETAILED DESCRIPTION

In some aspects of what is described here, a plug is disclosed for isolating a portion of a wellbore. The plug includes a tubular conduit having a first end and a second end. The plug also includes a cap disposed over the first end of the tubular conduit and coupled thereto. The cap is configured to mate with a wireline adapter kit of a perforating string. The plug additionally includes a guide shoe disposed over the second end of the tubular conduit and coupled thereto. The guide shoe is configured to move along the tubular conduit from an unset position, away from cap, to a set position, toward the cap. A gripping assembly is disposed around the tubular conduit between the cap and the guide shoe and coupled to the guide shoe. The gripping assembly is configured to expand outward from the tubular conduit in response to the guide shoe moving into the set position. A sealing assembly is disposed between the cap and the gripping assembly. The sealing assembly includes a first sealing band and a second sealing band. The first sealing band is disposed around the tubular conduit and has an annular lip. The second sealing band is disposed around the first sealing band and defines an angled channel with a tapered end of the cap. The annular lip of the first sealing band extends through the angled channel defined in part by the second sealing band. The second sealing band is configured to expand outward from the tubular conduit in response to the guide shoe moving into the set position.

In some implementations, the plug is disposed downhole into the wellbore during operations associated with extracting hydrocarbon fluid from a target reservoir formation. Such operations may include fracturing operations designed to re-invigorate a flow of hydrocarbon fluid out of a dormant wellbore and fracturing operations designed increase a flow of hydrocarbon fluid out of a newly-drilled wellbore. Other types of operations, however, are also possible (e.g., drilling).

Figure 1:
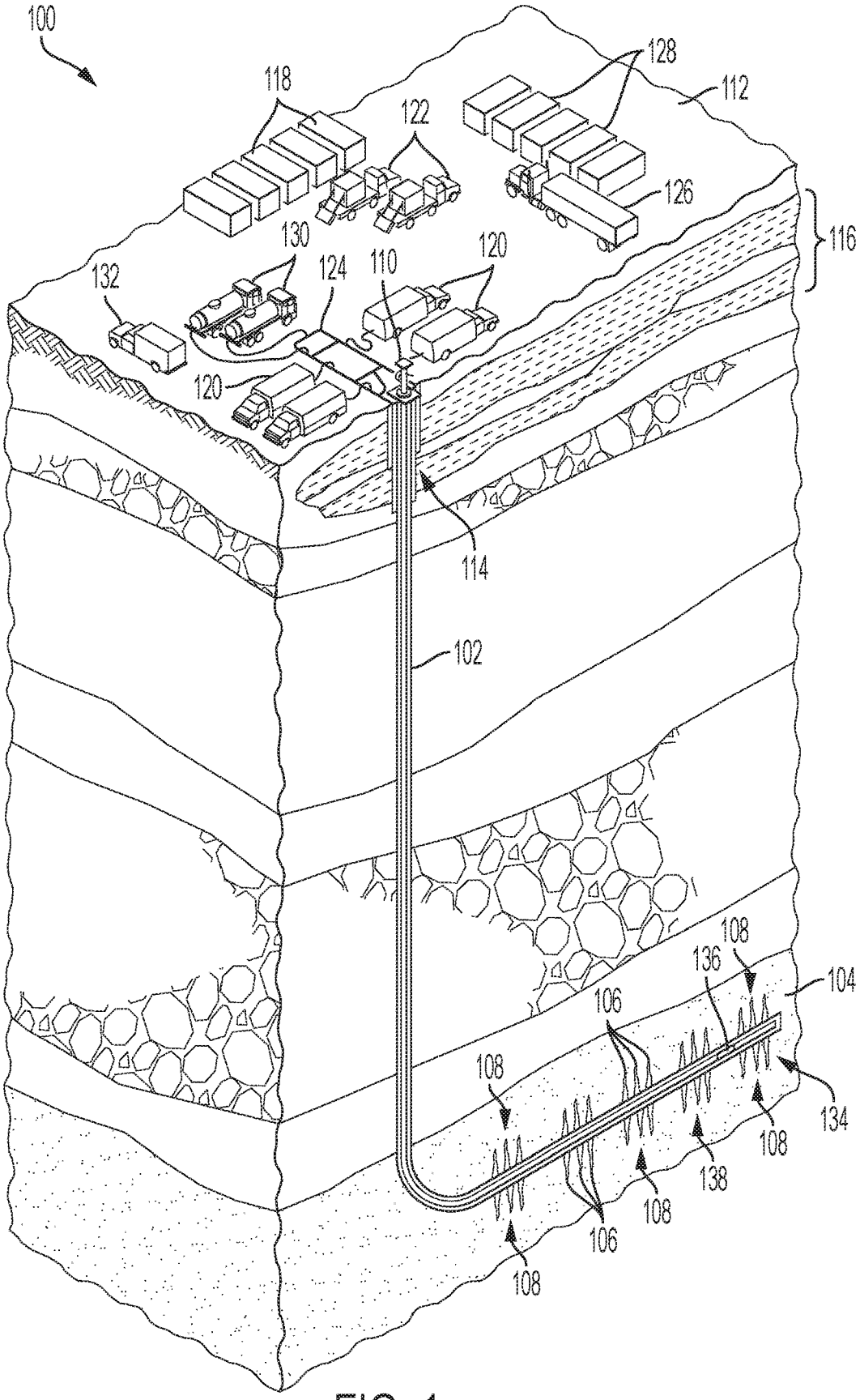
FIG. 1 is a schematic diagram, shown in perspective view, of an example well system having a wellbore for extracting hydrocarbon fluid from a target reservoir formation.

Now referring to FIG. 1, a schematic diagram is presented in perspective view of an example well system 100 having a wellbore 102 for extracting hydrocarbon fluid from a target reservoir formation 104. The well system 100 is presented in the context of a land-based fracturing operation. However, other environments and operations are possible (e.g., marine environments, drilling operations, etc.). A portion of the well system 100 is presented in cross-section, which includes the wellbore 102 and the target reservoir formation 104. The target reservoir formation 104 includes fractures 106 created by perforating guns that were deployed earlier in the fracturing operation. The perforating guns include radially-oriented explosive charges that, when fired, punch a pattern of openings through a cement casing (or wall) of the wellbore 102 and into the target reservoir formation 104. The patterns of openings create corresponding groups of fractures 108 within the target reservoir formation 104.

A wellhead 110 caps the wellbore 102 at a surface 112 of the well system 100 and terminates a series of concentric steel and cement encasements 114. The series of concentric steel and cement encasements may serve to protect higher-lying aquifer formations 116 during fracturing treatment of the wellbore 102. However, other purposes of the series of concentric steel and cement encasements 114 are possible. The well system 100 surrounding the wellhead 110 includes fracturing-fluid storage tanks 118 and fracturing-fluid pumping trucks 120. The fracturing-fluid pumping trucks 120 receive fracturing fluid from a blending truck 122 (or other source) and inject, under pressure, the fracturing fluid into the wellbore 102 through a conduit network 124. The conduit network 124 is connected to the wellhead 110, which controls transport of fluid into and out of the wellbore 102. Pressure exerted in the wellbore 102 by the fracturing fluid is sufficient to enhance an open configuration of the fractures 106 within the target reservoir formation 104 (e.g., by increasing cracks and porosity therein). The fractures 106 (and corresponding groups 110) may establish flow paths that improve a conductivity of hydrocarbon fluid out of the target reservoir formation 104 and into the wellbore 102.

The fractures 106 often require stabilization to prevent their collapse once the pressurized injection of the fracturing fluid ceases. To keep the fractures 106 open, proppant may be introduced into the target reservoir formation 104. For example, at the surface 108, a proppant truck 126 may transfer proppant from proppant storage tanks 128 to one or more blending trucks 122. The blending trucks 122 may also receive fracturing fluid from the fracturing-fluid storage tanks 118. Proppant and fracturing fluid are mixed by the blending trucks 122 to form a blended fracturing fluid, sometimes referred to as a "slurry", "proppant slurry", or "proppant gel". In some variations, chemical trucks 130 may deliver solid or liquid chemicals to the blending trucks 122 for inclusion into the blended fracturing fluid. Alternatively, such as shown in FIG. 1, the chemical trucks 130 may be fluidly-coupled to the conduit network 124. The blending trucks 122 and the chemical trucks 130 operate in coordination with the fracturing-fluid pumping trucks 120 to inject blended fracturing fluid into the wellbore 102 through the wellhead 110. This coordination is operable to force the transport of proppant downhole under pressure and into the fractures 106. The presence of proppant in the fractures 106 provides structural support that maintains the open configuration when pressurized injection from the surface 112 ceases.

A data monitoring truck 132 may coordinate operations of the fracturing-fluid pumping trucks 120, the blending trucks 122, and the chemical trucks 130 when injecting the blended fracturing fluid into the wellbore 102. The data monitoring truck 132 may be communicatively-coupled to the trucks 120, 122, 130 to control and monitor pressures and flow rates associated with the trucks 120, 122, 130, the conduit network 124, and the wellhead 110. The data monitoring truck 132 may also coordinate operations of the fracturing-fluid pumping trucks 120, the blending trucks 122, and the chemical trucks 130 to inject pressurized pulses of blended fracturing fluid in between volumes of clean fracturing fluid (e.g., containing no or insubstantial amounts of proppant). Such pulsing produces a pillar structure of proppant within the flow paths 102. The pillar structure contains open channels which enable a high conductivity of hydrocarbons out of the target reservoir formation 104 into the wellbore 102.

During any stage of the fracturing operation, a portion of the wellbore 102 may be isolated using a plug. For example, a first fracture group 134 may be opened by perforating guns within a terminal portion of the wellbore 102. This group 134 may subsequently be exposed to blended fracturing fluid under pressure and stabilized by proppant. The terminal portion of the wellbore 102 may then be isolated by a plug 136 to allow a second fracture group 138 to be opened within a portion of the wellbore 102 upstream of the terminal portion. After processing of the second fracture group 138 is complete, the plug 136 may be left in place within the wellbore 102 or drilled out. In many fracturing operations, the plug 136 is drilled out of the wellbore 102 using a drill bit coupled to a drill string. Such drill-out may occur during any stage of the fracturing operation, although the drill-out process typically occurs at an end of the fracturing operation when multiple plugs are present in the wellbore 102.

Successive portions of the wellbore 102 may be isolated by respective plugs to allow a successive sequence of fracture groups to be formed along the wellbore 102. FIG. 1 depicts a sequence of five such fracture groups 108 formed along a horizontal segment of the wellbore 102. However, any number of fracture groups 108 are possible within a wellbore. Moreover, the fracture groups 108 may be disposed in segments other than a horizontal segment (e.g., a vertical segment). The fracture groups 108 may also operate collectively to increase a hydrocarbon production capability of the wellbore 102, thereby increasing its revenue-generating capability.

Figure 2A:
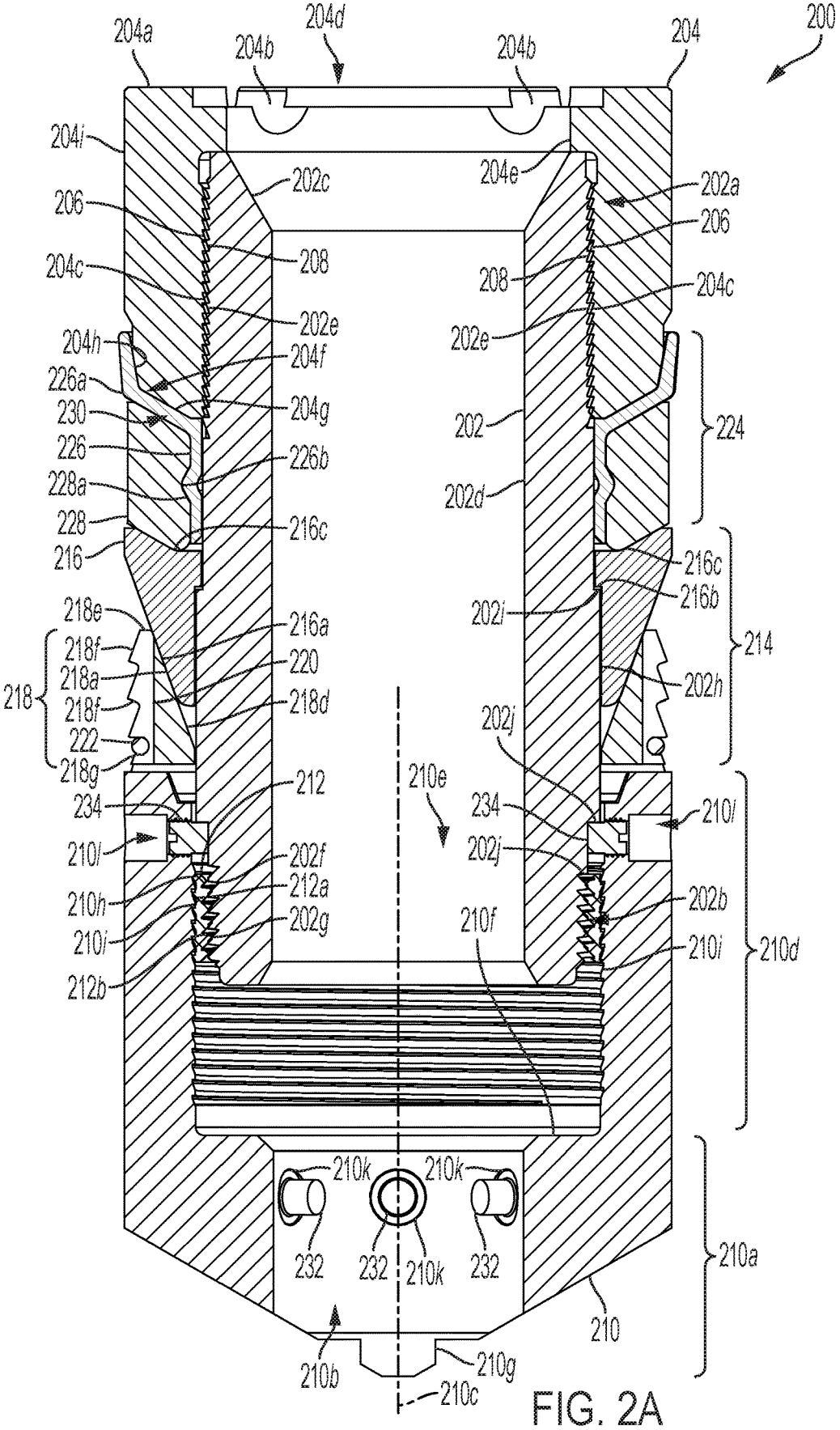
FIG. 2A is a schematic diagram, in cross-section, of an example plug for isolating a portion of a wellbore.
Figure 2B:
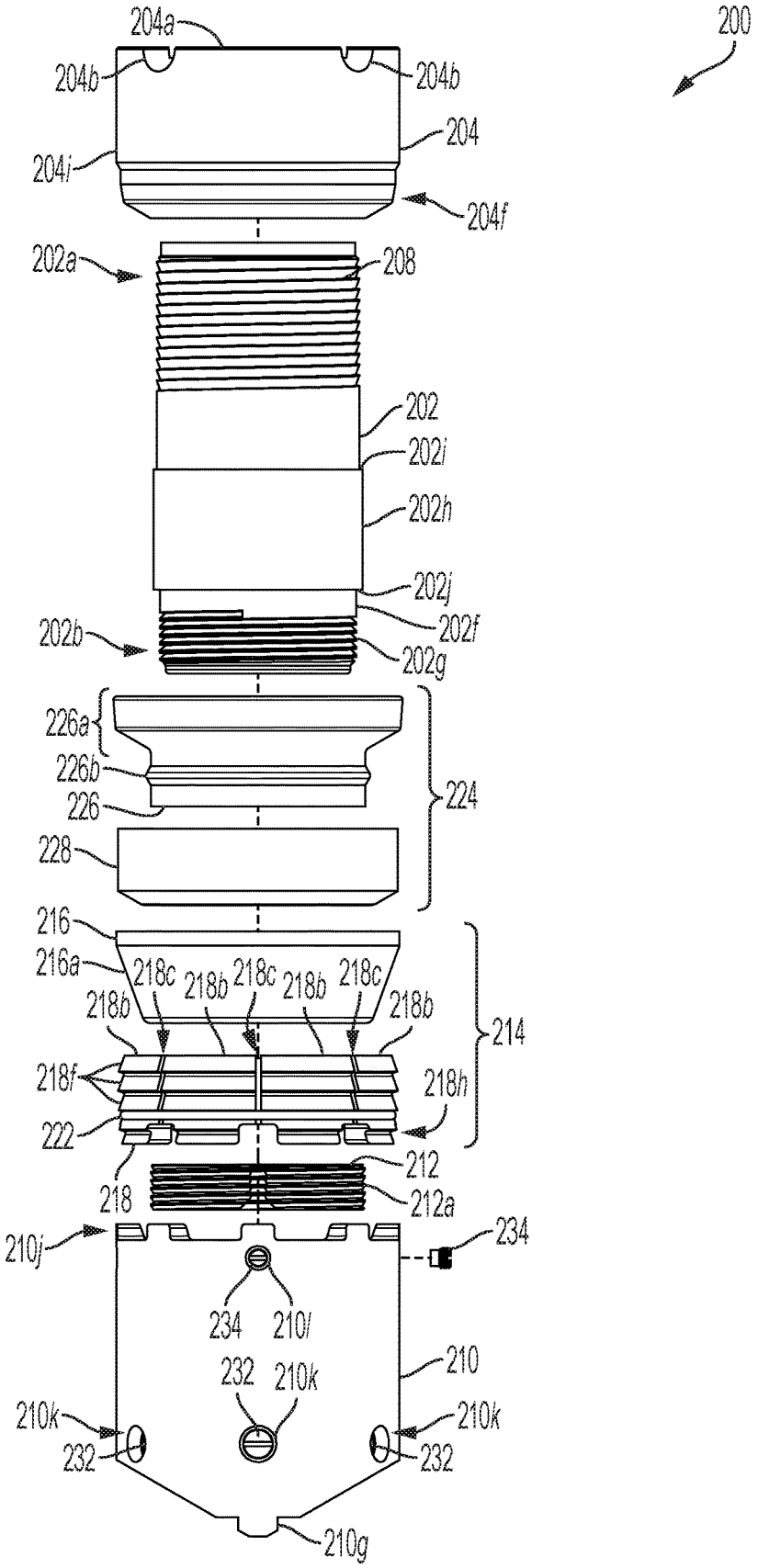
FIG. 2B is a schematic diagram of the example plug of FIG. 2A, but shown in exploded view.

Now referring to FIG. 2A, a schematic diagram is presented, in cross-section, of an example plug 200 for isolating a portion of a wellbore. The example plug 200 may be analogous to the plug 136 described in relation to FIG. 1. FIG. 2B presents a schematic diagram of the example plug 200 of FIG. 2A, but shown in exploded view. The plug 200 is compact in dimension, and as such, may allow for rapid drill-out after isolating the portion of the wellbore. Moreover, one or more components of the plug 200 may be formed of a composite material that is quickly milled by conventional drill bits. Such features, along with others described below, may allow the plug 200 to reduce processing times for extracting underground fluids via the wellbore. Other benefits are possible.

Figure 2C:
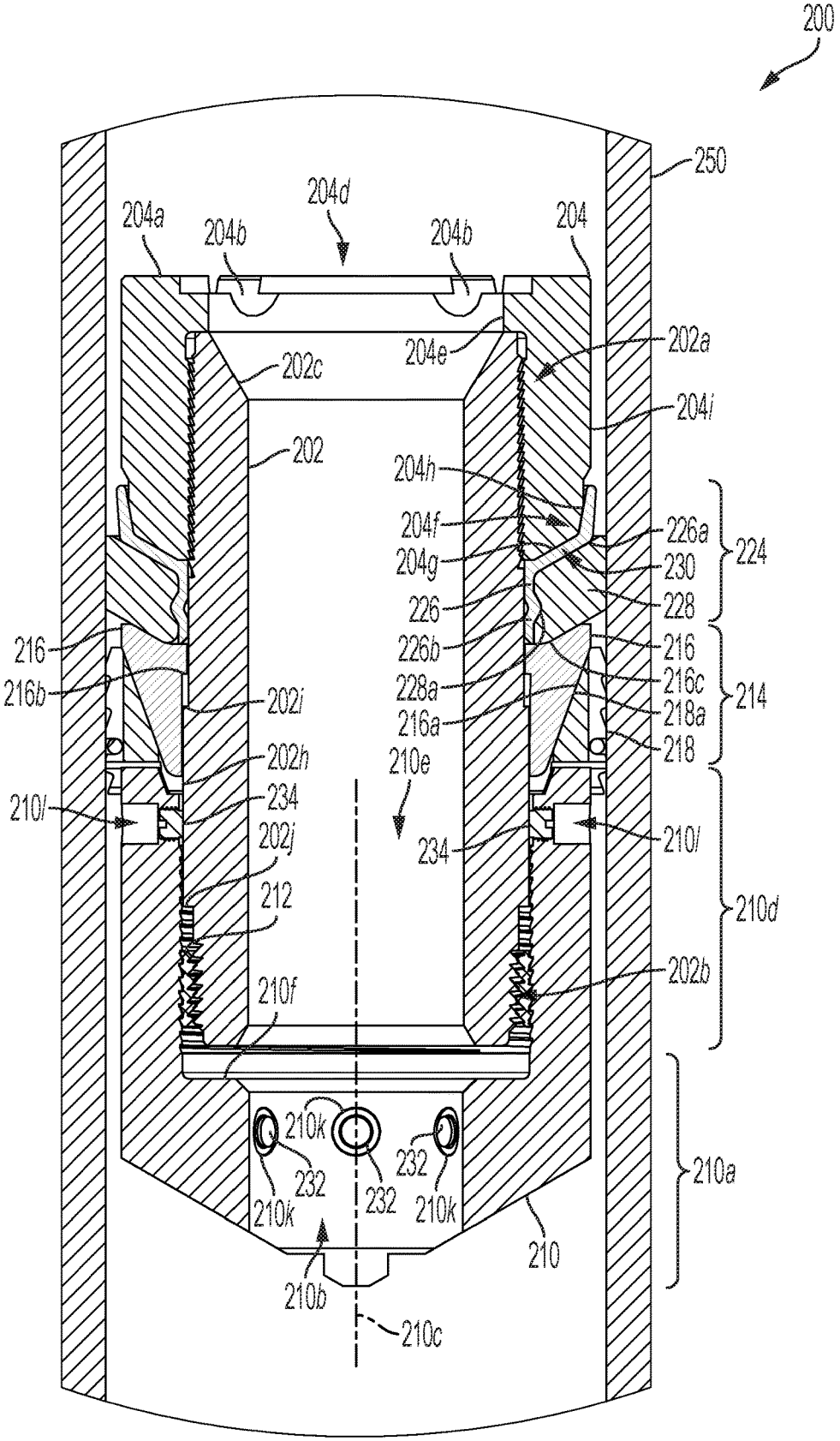
FIG. 2C is a schematic diagram, in cross-section, of the example plug of FIG. 2A, but in which a guide shoe of the plug is disposed in a set position.

The example plug 200 includes a tubular conduit 202 having a first end 202*a* and a second end 202*b*. The tubular conduit 202 may also have a receiving surface 202*c* at the first end 202*a* configured to mate with a plug body. For example, as shown in FIG. 2A, the first end 202*a* of the tubular conduit 202 may include an interior bevel configured to seat a plug body, such as a ball. The ball, when in contact with the interior bevel may occlude a through-bore 202*d* of the tubular conduit 202, thereby preventing (or significantly blocking) a flow of fluid through the tubular conduit 202. The plug 200 also includes a cap 204 disposed over the first end 202*a* of the tubular conduit 202 and coupled thereto. The cap 204 is configured to mate with a wireline adapter kit of a perforating string. Such mating may involve an outer diameter of the wireline adapter kit seating within an inner diameter of the cap 204, as will be described further in relation to FIG. 3. The cap 204 may include an exterior surface 204*a* configured to face upstream when the plug 200 is disposed within the wellbore. The exterior surface 204*a* has a notch 204*b* formed therein. In many variations, the notch 204*b* is configured to receive a leading-edge portion of a second plug, which may be a second instance of the plug 200. The notch 204*b* may receive the leading-edge portion as the second plug moves downstream from a position upstream of the plug 200 and contacts the exterior surface 204*a* of the cap 204. The notch 204*b*, when seating the leading-edge portion, may prevent the second plug from rotating during drill-out. FIGS. 2A-2C depict the cap 204 as having four notches 204*b*. However, other numbers of notches are possible for the cap 204, including different configurations of notches.

In some variations, the cap 204 couples to the first end 202*a* of the tubular conduit 202 through a mated pair of threads 206, 208, such as shown in FIGS. 2A-2B. In particular, an inner circumferential surface 204*c* of the cap 204 may define inner threads 206 configured to mate with outer threads 208 of an outer circumferential surface 202*e* of the first end 202*a*. In some variations, the cap 204 includes a through hole 204*d* and a protrusion 204*e* therein. The protrusion 204*e* may extend around an inner surface of the through hole 204*d* to complete a full circumference, or alternatively, extend around the inner surface of the through hole 204*d* to complete a partial circumference. In these variations, the first end 202*a* of the tubular conduit 202 is disposed against the protrusion 204*e*.

The example plug 200 additionally includes a guide shoe 210 disposed over the second end 202*b* of the tubular conduit 202 and coupled thereto. The example guide shoe 210 is configured to move along the tubular conduit 202 from an unset position, away from the cap 204, to a set position, towards the cap 204. FIG. 2A depicts the guide shoe 210 in the unset position, whereas FIG. 2C depicts the guide shoe 210 in the set position. Although FIG. 2C presents the plug 200 within the context of a wellbore encasement 250, other contexts are possible for the plug 200 when the guide shoe 210 is in the set position. Some features of FIG. 2A indicated by numerated leaders are omitted from FIG. 2C for purposes of clarity.

In some variations, the guide shoe 210 includes a first portion 210*a* having a first hole 210*b* disposed along a longitudinal axis 210*c* of the guide shoe 210. The example guide shoe 210 also includes a second portion 210*d* having a second hole 210*e* disposed along the longitudinal axis 210*c* of the guide shoe 210. The second hole 210*e* is larger in diameter than the first hole 210*b* and meets the first hole 210*b* at an internal shoulder 210*f*. In these variations, the second end 202*b* of the tubular conduit 202 is disposed within the second hole 210*e*. When the guide shoe 210 is in the unset position, such as shown in FIG. 2A, the second end 202*b* of the tubular conduit 202 is offset from the internal shoulder 210*f*. When guide shoe 210 is in the set position, such as shown in FIG. 2C, the second end 202*b* of the tubular conduit 202 is disposed adjacent the internal shoulder 210*f* at a distance smaller than the offset. In some instances, the second end 202*b* of the tubular conduit 202 contacts the internal shoulder 210*f* when the guide shoe 210 is in the set position.

In some variations, the guide shoe 210 is shaped to lower a drag of the plug 200 when the plug 200 is transported through the wellbore. For example, as shown in FIGS. 2A-2C, the guide shoe 210 may have a wedge shape. However, other shapes are possible (e.g., a conical shape). In some variations, the guide shoe 210 includes a leading-edge portion 210*g*. The leading-edge portion 210*g* may be operational to split fluid in the wellbore and direct such fluid across surfaces of the guide shoe 210 (e.g., surfaces of the wedge shape). The leading-edge portion 210*g* may also be operable to contact a cap of another plug and seat within a notch of the cap.

In variations where the guide shoe 210 includes the first portion 210*a* and the second portion 210*d*, the second end 202*b* of the tubular conduit 202 may couple to the guide shoe 210 through a ratcheting assembly. The ratcheting assembly may be configured to allow the guide shoe 210 to move from the unset position to the set position while preventing the guide shoe 210 from moving in reverse. For example, the plug 200 may include a locking ring 212 disposed between an outer circumferential surface 202*f* of the second end 202*b* of the tubular conduit 202 and an inner circumferential surface 210*h* of the second hole 210*e* of the guide shoe 210. The locking ring 212 includes outward-facing annular teeth 212*a* that engage inward-facing annular teeth 2101 on the inner circumferential surface 210*h* of the second hole 210*e* of the guide shoe 210, thereby defining a first set of ratcheting teeth. The locking ring 212 also includes inward-facing annular teeth 212*b* that engage outward-facing annular teeth 202*g* on the outer circumferential surface 202*f* of the second end 202*b* of the tubular conduit 202, thereby defining a second set of ratcheting teeth. The first and second sets of ratcheting teeth are configured to allow the guide shoe 210 to move from the unset position to the set position while preventing the guide shoe 210 from moving in reverse. In some instances, the first set of ratcheting teeth is shallower than the second set of ratcheting teeth. In some instances, the first and second sets of ratcheting teeth are defined by, respectively, first and second sets of mating threads, such as shown in FIGS. 2A-2C.

The example plug 200 also includes a gripping assembly 214 disposed around the tubular conduit 202 between the cap 204 and the guide shoe 210 and coupled to the guide shoe 210. The example gripping assembly 214 is configured to expand outward in response to the guide shoe 210 moving into the set position. In some variations, the gripping assembly 214 includes a conical ring 216 and an expandable ring 218. The example conical ring 216 has an outer beveled surface 216*a* that tapers in a direction of the second end 202*b* of the tubular conduit 202. The example expandable ring 218 has an inner beveled surface 218*a* configured to mate against the outer beveled surface 216*a* of the conical ring 216.

In some variations, the conical ring 216 is mated to a structural feature of the tubular conduit 202 to prevent movement of the conical ring 216 towards the guide shoe 210. Such mating may prevent the gripping assembly 214 from expanding outward from the tubular conduit 202 in response to forces or pressures encountered during transport of the plug 200 downhole. For example, the tubular conduit 202 may include an exterior circumferential surface having a raised portion 202*h* between the first end 202*a* and the second end 202*b*. The raised portion 202*h* has a larger diameter than adjacent portions of the tubular conduit 202 and is bounded by a first shoulder 202*i* facing the first end 202*a* and a second shoulder 202*j* facing the second end 202*b*. The first shoulder 202*i* may be configured to engage a mating shoulder 216*b* on an inner circumferential surface of the conical ring 216. Such engagement may prevent the conical ring 216 moving towards the guide shoe 210, e.g., in response to friction with an inner surface of the wellbore, contact with fluid driving the plug 200 downhole through the wellbore, and so forth.

In some variations, the expandable ring 218 includes a plurality of tabs 218*b* disposed circumferentially around the tubular conduit 202. The plurality of tabs 218*b* may be configured to displace outward from the tubular conduit 202 in response to the guide shoe 210 moving into the set position. For example, the plurality of tabs 218*b* may be separated by partial gaps 218*c* within the expandable ring 218. As the guide shoe 210 moves into the set position, the partial gaps 218*c* may grow in length, propagating completely through the expandable ring 218 and breaking the expandable ring 218 into a plurality of segments. The partial gaps 218*c* may thus prevent the expandable ring 218 from breaking into a C-shaped body. Moreover, the resulting plurality of segments may allow the gripping assembly 214 of the plug 200 to more uniformly engage the wellbore when disposed downhole. In many instances, the number of segments matches the number of tabs 218*b* originally present in the expandable ring 218.

In some variations, the expandable ring 218 includes a conical portion 218*d* disposed around the tubular conduit 202 that defines the inner beveled surface 218*a*. The conical portion 218*d* may be coupled to a cladding portion 218*e* that includes outward-facing annular teeth 218*f*. Such coupling may occur along an interface 220 that includes an outward-facing surface of the conical portion 218*d* and an inward-facing surface of the cladding portion 218*e*. The conical portion 218*d* may be formed of a material different than that forming the cladding portion 218*e*. For example, the material forming the conical portion 218*d* may be softer, lighter, or both, than that forming the cladding portion 218*e*. In some instances, the conical portion 218*d* is formed of a composite material (e.g., glass fibers in a plastic matrix) and the cladding portion 218*e* is formed of a metallic material (e.g., cast iron). In some instances, the cladding portion 218*e* may include an annular groove 218*g* configured to seat an O-ring 222.

In some variations, the gripping assembly 214 couples to the guide shoe 210 through a circumferential set of interlocking tabs, such as shown in FIG. 2B. In particular, the second portion 210*d* of the guide shoe 210 may couple to the gripping assembly 214 through a crown 210*j* configured to interlock with a mating crown 218*h* of the gripping assembly 214. The mating crown 218*h* may be part of the expandable ring 218 of the gripping assembly 214. However, depending upon a configuration of the gripping assembly 214, the mating crown 218*h* may be disposed elsewhere (e.g., a separate component of the gripping assembly 214). The crowns 210*j*, 218*h* may be operable to prevent the gripping assembly 214 from rotating about the tubular conduit 202 as the plug 200 is transported through the wellbore. The crowns 210*j*, 218*h* may also be operable to prevent the gripping assembly 214 from rotating about the tubular conduit 202 as the plug 200 is drilled out of the wellbore. In some instances, the crowns 210*j*, 218*h* allow the gripping assembly 214 to break into even parts. For example, the crowns 210*j*, 218*h* may assist the partial gaps 218*c* in breaking the expandable ring 218 breaking into a plurality of segments that are similar in size.

The example plug 200 additionally includes a sealing assembly 224 disposed between the cap 204 and the gripping assembly 214. The example sealing assembly 224 includes a first sealing band 226 disposed around the tubular conduit 202 and having an annular lip 226*a*. The example sealing assembly 224 also includes a second sealing band 228 disposed around the first sealing band 226 and defining an angled channel 230 with a tapered end 204*f* of the cap 204. The conical ring 216 may include an annular pocket 216*c* for seating at least the second sealing band 228 of the sealing assembly 224. The example second sealing band 228 is configured to expand outward from the tubular conduit 202 in response to the guide shoe 210 moving into the set position. The first sealing band 226 and the second sealing band 228 may be formed of an elastomeric material. In some variations, an inward-facing surface of the second sealing band 228 includes a groove 228*a* configured to seat a protrusion 226*b* of an outward-facing surface of the first sealing band 226. The protrusion 226*b* may allow the first sealing band 226 to fold outward in response to the guide shoe 210 moving into the set position. Such folding may enhance the expansion of the second sealing band 228 outward from the tubular conduit 202, thereby improving a sealing capability of the sealing assembly 224.

In some variations, such as shown in FIGS. 2A-2C, the tapered end 204*f* of the cap 204 includes a first tapered surface 204*g* defining the angled channel 230 with the second sealing band 228. The example tapered end 204*f* also includes a second tapered surface 204*h* supporting a portion of the annular lip 226*a* that extends outside of the angled channel 230. The example second tapered surface 204*h* is recessed relative to an outer circumferential surface 204*i* the cap 204. In these variations, a recess depth of the second tapered surface 204*h* may help set a protrusion of the annular lip 226*a* past the outer circumferential surface 204*i*. The protrusion, if present, may help the annular lip 226*a* capture fluid during transport of the plug 200 downhole through the wellbore. The protrusion may also help the annular lip 226*a* wipe an inner surface of the wellbore during transport of the plug 200 downhole through the wellbore. In some variations, an angular orientation of the second tapered surface 204*h* is more shallow, relative to the outer circumferential surface 204*i* of the cap 204, than an angled orientation of the first tapered surface 204*g*.

Figure 3:
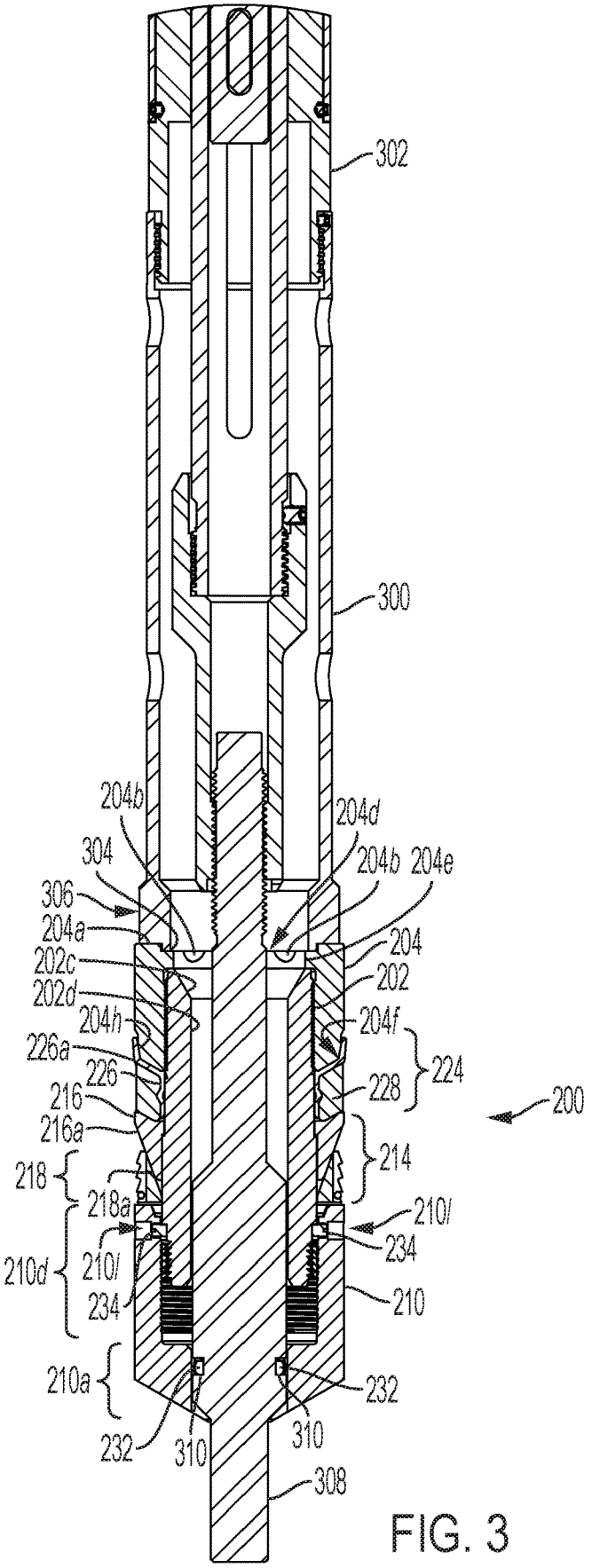
FIG. 3 is a schematic diagram, in cross-section, of the example plug of FIG. 2A coupled to a wireline adapter kit of a perforating string.

In operation, the example plug 200 may be coupled to a wireline adapter kit of a perforating string. Coupling of the plug 200 to the wireline adapter kit may allow the plug 200 to remain secure to the perforating string while being transported downhole. FIG. 3 presents a schematic diagram, in cross-section, of the example plug 200 of FIG. 2A, but in which the plug 200 is coupled to an example wireline adapter kit 300. The wireline adapter kit 300 terminates an end 302 of a perforating string. In some variations, the wireline adapter kit 300 includes an annular ring 304 extending from a flanged end 306. The annular ring 304 may seat within the cap 204 and against the protrusion 204*e* of the cap 204. Such seating may align the wireline adapter kit 300 with the plug 200, thereby assisting the plug 200 in coupling to the wireline adapter kit 300.

Now referring to FIGS. 2A-2C and FIG. 3, the first portion 210*a* of the guide shoe 210 may include a radially-aligned hole 210*k* containing at least part of a frangible pin 232. The radially-aligned hole 210*k* and frangible pin 232 may allow the plug 200 to couple to the wireline adapter kit 300. In many instances, the radially-aligned hole 210*k* and frangible pin 232 are threaded to define mated set of threads. Moreover, the first portion 210*a* of the guide shoe 210 may include a plurality of holes 210*k* and respective pins 232. For example, the plug 200 depicted in FIGS. 2A-2C has six radially-aligned holes 210*k* and six respective frangible pins 232. However, other numbers of holes 210*k* and respective pins 232 are possible.

To couple the plug 200 to the wireline adapter kit 300, a mandrel 308 of the wireline adapter kit may be inserted through the plug 200. During such insertion, the mandrel 308 traverses the through hole 204*d* of the cap 204, the through-bore 202*d* of the tubular conduit 202, and the first and second holes 210*b*, 210*e* of the guide shoe 210. The plug 200 is then rotated to line up the radially-aligned holes 210*k* with corresponding holes 310 in the mandrel 308. The example frangible pins 232 are each subsequently displaced inward until a portion resides within a respective hole 310 of the mandrel 308. Such displacement may involve turning the frangible pins 232 within their respective radially-aligned holes 210*k* (e.g., if threaded). Because each frangible pin 232 connects one radially-aligned hole 210*k* with a respective hole 310 in the mandrel 308, the plug 200 is prevented from translating longitudinally and rotationally on the mandrel 308.

After coupling to the wireline adapter kit 300, the plug 200 may be inserted into the wellbore along with the wireline adapter kit 300 and the perforating string. The perforating string may include other downhole tools, such as perforating guns. Fluid may then be pumped into the wellbore to establish a fluid pressure capable of driving the plug 200 through the wellbore to a target position. The fluid pressure may be altered to adjust to changes in environment of the wellbore, such as a bend in the encasement, an increased back-pressure, and so forth. During transport downhole, the sealing assembly 224 of the plug 200 may interact with the fluid and the wellbore. For example, the annular lip 226*a* of the first sealing band 226 may capture a portion of the fluid being pumped into the wellbore. Such capture may include fluid interrupting contact of the annular lip 226*a* with the second tapered surface 204*h*, thereby displacing the annular lip 226*a* outward from the cap 204. The capture of fluid may allow the plug 200 (and perforating string) to be more easily transported through the wellbore, such as through a lower fluid pressure. In another example, the annular lip 226*a* of the first sealing band 226 may wipe an inner surface of the wellbore as the plug 200 moves downhole. Such wiping may be in response to the pressurized fluid interrupting contact of the annular lip 226*a* with the second tapered surface 204*h*. Wiping may clear the wellbore of debris that might otherwise snag, clog, or prevent proper operation of the plug 200 or other downhole tools of the perforating string, including the perforating string itself.

When the example plug 200 reaches the target position, one or more wellbore operations may commence. As a part of the wellbore operations, the plug 200 may be set to isolate a portion of the wellbore. To do so, the guide shoe 210 may be moved along the tubular conduit 202 from the unset position, away from the cap 204, to the set position, towards the cap 204. Such movement may include the mandrel 308 moving towards the cap 204. In many variations, the guide shoe 210 is configured to prevent premature movement. For example, the second portion 210*d* of the guide shoe 210 may include a radially-aligned hole 210*l* containing at least part of a frangible pin 234. A portion of the frangible pin 234 may extend out of the radially-aligned hole 210*l* to contact the second shoulder 202*j* of the tubular conduit 202. As shown in FIG. 2A, the second shoulder 202*j* blocks movement of the frangible pin 234 (and hence the guide shoe 210) towards the cap 204. However, the frangible pin 234 may be broken by displacing the mandrel 308 within the plug 200 towards the cap 204. In particular, the mandrel 308 and the guide shoe 210 move relative to the cap 204 and the tubular conduit 202, thereby allowing the second shoulder 202*j* to shear the frangible pin 234. Motion of the mandrel 308 may be actuated by an operator system located at a surface of the wellbore. FIG. 3 depicts the mandrel 308 in an unactuated state.

As the example plug 200 is set, the example gripping assembly 214 responds to movement of the guide shoe 210 by moving the expandable ring 218 towards the cap 204 and over the conical ring 216. During such movement, the inner beveled surface 218*a* of the expandable ring 218 slides over the outer beveled surface 216*a* of the conical ring 216, pushing the expandable ring 218 outwards towards the inner surface of the wellbore. The example expandable ring 218 then contacts the inner surface of the wellbore, allowing the outward-facing annular teeth 218*f* to bite into the wellbore and secure the plug 200 at the target position. The example conical ring 216 also moves towards the cap 204 in response to movement of the guide shoe 210. Such movement may force the sealing assembly 224 against the tapered end 204*f* of the cap 204, thereby compressing and pushing the second sealing band 228 outwards towards the inner surface of the wellbore. The second sealing band 228 may then contact the inner surface of the wellbore, forming an annular seal around the wellbore. FIG. 2C illustrates contact of the second sealing band 228 with the inner surface of the wellbore.

After the plug 200 is set, the mandrel 308 may be withdrawn from the plug 200, allowing the plug 200 to de-couple from the wireline adapter kit 300. During such withdrawal, the holes 310 of the mandrel 308 may operate collectively with the radially-aligned holes 210*k* of the guide shoe 210 to shear the frangible pins 232. The wireline adapter kit 300 and associated perforating string may then be removed from the wellbore. After removal of the perforating string, a plug body may be transported downhole to the plug 200 to contact the receiving surface 202*c* of the tubular conduit 202. For example, a ball may be dropped downhole to contact an interior bevel of the tubular conduit 202. Upon contact, the plug body occludes the through-bore 202*d* of the tubular conduit 202, thereby preventing (or significantly blocking) a flow of fluid through the tubular conduit 202. Such occlusion allows the plug 200 to isolate a downstream portion of the wellbore from an upstream portion. When the isolating functionality of the plug 200 is no longer desired, the plug 200 may be drilled-out of the wellbore as described previously in relation to FIG. 1.

One or more components of the example plug 200 may be formed of a composite material to hasten drill-out of the plug 200 by a drill string. For example, at least one of the tubular conduit 202, the cap 204, the guide shoe 210, and the conical ring 216 may be formed of a composite material. In some variations, the composite material includes a plastic material serving as a matrix. Examples of the plastic material include thermosetting plastics such as polyether ether ketone (PEEK). The composite material also includes inclusions disposed within the matrix. The inclusions may be woven fabrics, fibers, granules, particles, powders, hollow spheres, and so forth. The inclusions may be formed of a glass material, a ceramic material, an aramid material, or a graphitic material.

In certain situations, the plug 200 may be set within the wellbore and an upstream plug subsequently disposed and set within the wellbore, such as described in relation to FIG. 1. In these situations, the notch 204*b* of the plug 200 may facilitate a drill-out operation. For example, the drill-out operation may utilize a drill bit to mill through the upstream plug and the plug 100. In this operation, the drill bit will encounter the upstream plug before the plug 100, and as such, the upstream plug may dislodge and fall downstream towards the plug 100. Such motion may result from the drill bit milling through a portion of the upstream plug, such as a gripping assembly, but without milling through an entirely of the upstream plug. The upstream plug may thus fall onto the plug 200 and contact the cap 204 of the plug 200.

The upstream plug may include a leading-edge portion, especially if the upstream plug is a second instance of the plug 200. The leading-edge portion may seat within one or more notches 204*b* of the plug 200. This seating may be aided by the drill bit re-engaging the upstream plug (e.g., through milling forces such as rotational forces, downhole-directed forces, etc.). Once seated, the leading-edge portion may secure the upstream plug to the plug 200, thus preventing the upstream plug from spinning while the drill bit completely mills through the upstream plug. The one or more notches 204*b* of the plug 200 may thus hasten drill-out of the upstream plug. It will be understood that the plug 200 may facilitate drill-out of an entire productive length of the wellbore, especially when multiple instances of the plug 200 are disposed and set within the wellbore.

In other aspects of what is described here, a method for isolating a portion of a wellbore includes transporting a plug through the wellbore using a fluid. The fluid may be pumped into the wellbore to establish a fluid pressure therein. The plug includes a tubular conduit having a first end and a second end. The plug also includes a cap disposed over the first end of the tubular conduit and coupled thereto. The plug additionally includes a sealing assembly having a first sealing band and a second sealing band. The first sealing band is disposed around the tubular conduit and has an annular lip. The second sealing band is disposed around the first sealing band and defines an angled channel with a tapered end of the cap. The annular lip of the first sealing band extends through the angled channel. The method also includes capturing a portion of the fluid using the annular lip of the first sealing band while transporting the plug through the wellbore. In some implementations, the operation of capturing the portion of the fluid includes wiping an inner surface of the wellbore with the annular lip of the first sealing band.

In some implementations, the method includes coupling a wireline adapter kit of a perforating string to the plug. Such coupling may include disposing a mandrel of a wireline adapter kit through the plug. The mandrel may traverse a through hole of the cap, a through-bore of the tubular conduit, and first and second holes of a guide shoe. Such coupling may also include coupling the mandrel of the wireline adapter kit to the guide shoe of the plug via a frangible pin. In further implementations, the method includes decoupling the wireline adapter kit of the perforating string from the plug. Such decoupling may include withdrawing a mandrel of the wireline adapter kit from the plug. Such coupling may also include de-coupling the mandrel of the wireline adapter kit from the guide shoe of the plug by breaking the frangible pin.

In some implementations, the method includes moving a guide shoe of the plug along the tubular conduit from an unset position, away from cap, to a set position, toward the cap. The operation of moving the guide shoe may include breaking a first frangible pin disposed at least partially within a first radially-aligned hole of the guide shoe. In these implementations, the method also includes expanding the second sealing band outward from the tubular conduit in response to the guide shoe moving to the set position.

In further implementations, the method includes displacing a wireline adapter kit relative to the plug to break a second frangible pin disposed at least partially in a second radially-aligned hole of the guide shoe. The wireline adapter kit is coupled to a perforating string. In some instances, the method may also include receiving a plug body at the first end of the tubular conduit. The plug body is configured to mate with a receiving surface of the first end, thereby occluding the tubular conduit.

In some implementations, the method includes moving a guide shoe of the plug along the tubular conduit from an unset position, away from cap, to a set position, toward the cap. The method also includes expanding the second sealing band outward from the tubular conduit in response to the guide shoe moving to the set position and expanding a gripping assembly of the plug outward from the tubular conduit in response to the guide shoe moving to the set position. The gripping assembly may be disposed around the tubular conduit between the cap and the guide shoe and coupled to the guide shoe. The sealing assembly may be disposed between the cap and the gripping assembly.

The operation of moving the guide shoe may include contacting the second end of the tubular conduit against an internal shoulder of the guide shoe when the guide shoe reaches the set position. The operation of moving the guide shoe may also include breaking a first frangible pin disposed at least partially within a first radially-aligned hole of the guide shoe.

In further implementations, the method includes displacing a wireline adapter kit relative to the plug to break a second frangible pin disposed at least partially in a second radially-aligned hole of the guide shoe. The wireline adapter kit is coupled to a perforating string. The method may include receiving a plug body at the first end of the tubular conduit. The plug body is configured to mate with a receiving surface of the first end, thereby occluding the tubular conduit.

A plug for isolating a portion of a wellbore may also be described by the following examples:

Example 1. A plug for isolating a portion of a wellbore, the plug comprising:

- a tubular conduit having a first end and a second end;
- a cap disposed over the first end of the tubular conduit and coupled thereto, the cap configured to mate with a wireline adapter kit of a perforating string;
- a guide shoe disposed over the second end of the tubular conduit and coupled thereto, the guide shoe configured to move along the tubular conduit from an unset position, away from cap, to a set position, toward the cap;
- a gripping assembly disposed around the tubular conduit between the cap and the guide shoe and coupled to the guide shoe, the gripping assembly configured to expand outward from the tubular conduit in response to the guide shoe moving into the set position; and
- a sealing assembly disposed between the cap and the gripping assembly and comprising:
  - a first sealing band disposed around the tubular conduit and having an annular lip,
  - a second sealing band disposed around the first sealing band and defining an angled channel with a tapered end of the cap, the annular lip of the first sealing band extending through the angled channel, the second sealing band is configured to expand outward from the tubular conduit in response to the guide shoe moving into the set position.

Example 2. The plug of example 1, wherein the tubular conduit, the cap, and the guide shoe are formed of a composite material.

Example 3. The plug of example 1 or 2, wherein the first sealing band and the second sealing band of the sealing assembly are formed of an elastomeric material.

Example 4. The plug of example 1 or any of examples 2-3, wherein the first end of the tubular conduit comprises an interior bevel configured to seat a ball.

Example 5. The plug of example 1 or any of examples 2-4, wherein the cap comprises a through hole and a protrusion therein, the first end of the tubular conduit disposed against the protrusion.

Example 6. The plug of claim 1 or any of examples 2-5, wherein the cap comprises an exterior surface configured to face upstream when the plug is disposed within the wellbore, the exterior surface having a notch formed therein.

Example 7. The plug of example 1 or any of examples 2-6, wherein the tapered end of the cap comprises:

- a first tapered surface defining the angled channel with the second sealing band; and
- a second tapered surface supporting a portion the annular lip that extends outside of the angled channel, the second tapered surface recessed relative to an outer circumferential surface of the cap.

Example 8. The plug of example 7, wherein an angled orientation of the second tapered surface is more shallow, relative to the outer circumferential surface of the cap, than an angled orientation of the first tapered surface.

Example 9. The plug of example 1 or any of examples 2-8, wherein an inward-facing surface of the second sealing band comprises a groove configured to seat a protrusion of an outward-facing surface of the first sealing band.

Example 10. The plug of example 1 or any of examples 2-9 wherein the grip assembly comprises:

- a conical ring having an outer beveled surface that tapers in a direction of the second end of the tubular conduit; and an expandable ring having an inner beveled surface configured to mate against the outer beveled surface of the conical ring.

Example 11. The plug of example 10, wherein the expandable ring comprises a plurality of tabs disposed circumferentially around the tubular conduit and configured to displace outward from the tubular conduit in response to the guide shoe moving into the set position.

Example 12. The plug of example 10 or 11, wherein the expandable ring comprises one or more annular teeth defined by an exterior surface of the expandable ring.

Example 13. The plug of example 10 or any of examples 11-12, wherein the expandable ring is formed of a metallic material.

Example 14. The plug of example 10 or any of examples 11-12, wherein the expandable ring is formed of a metallic material and a composite material.

Example 15. The plug of example 10 or any of examples 11-14, wherein the conical ring comprises an annular pocket for seating at least the second sealing band of the sealing assembly.

Example 16. The plug of example 10 or any of examples 11-15, wherein the tubular conduit comprises a raised portion between the first end and the second end, the raised portion bounded by a first shoulder facing the first end; and wherein the conical ring comprises a mating shoulder on an inner circumferential surface of the conical ring, the mating shoulder disposed against the first shoulder of the raised portion.

Example 17. The plug of example 10 or any of examples 11-16, wherein the conical ring is formed of a composite material.

Example 18. The plug of example 1 or any of examples 2-17, wherein the guide shoe comprises:

a first portion having a first hole disposed along a longitudinal axis of the guide shoe;

a second portion having a second hole disposed along the longitudinal axis of the guide shoe, the second hole larger in diameter than the first hole and meeting the first hole at an internal shoulder; and wherein the second end of the tubular conduit is disposed within second hole, and when the guide shoe is in the unset position, the second end of the tubular conduit is offset from the internal shoulder, and when the guide shoe is in the set position, the second end of the tubular conduit is disposed against the internal shoulder.

Example 19. The plug of example 18, wherein the second portion of the guide shoe comprises a radially-aligned hole containing at least part of a frangible pin.

Example 20. The plug of example 18 or 19, wherein the first portion of the guide shoe comprises a radially-aligned hole containing at least part of a frangible pin.

Example 21. The plug of example 18 or any of examples 19-20, wherein the second portion of the guide shoe couples to the gripping assembly through a crown configured to interlock with a mating crown of the gripping assembly.

Example 22. The plug of example 18 or any of examples 19-21, wherein the second end of the tubular conduit couples to the second hole of the guide shoe through a ratcheting assembly.

Example 23. The plug of example 18 or any of examples 19-21, wherein second end of the tubular conduit couples to the second portion of the guide shoe through a ratcheting assembly, the ratcheting assembly configured to allow the guide shoe to move from the unset position to the set position while preventing the guide shoe from moving in reverse.

Example 24. The plug of example 18 or any of examples 19-23, wherein plug comprises:

a locking ring disposed between an outer circumferential surface of the second end of the tubular conduit and an inner circumferential surface of the second hole of the guide shoe, the locking ring comprising:

outward-facing annular teeth that engage inward-facing annular teeth on the inner circumferential surface of the second hole of the guide shoe, thereby defining a first set of ratcheting teeth, and inward-facing annular teeth that engage outward-facing annular teeth on the outer circumferential surface of the second end of the tubular conduit, thereby defining a second set of ratcheting teeth, wherein the first and second sets of ratcheting teeth are configured to allow the guide shoe to move from the unset position to the set position while preventing the guide shoe from moving in reverse.

Example 25. The plug of example 24, wherein the first set of ratcheting teeth is shallower than the second set of ratcheting teeth.

A method of isolating a portion of a wellbore may also be described by the following examples:

Example 26. A method of isolating a portion of a wellbore, the method comprising:

transporting a plug through the wellbore using a fluid, the plug comprising:

a tubular conduit having a first end and a second end, a cap disposed over the first end of the tubular conduit and coupled thereto, and a sealing assembly having a first sealing band and a second sealing band, the first sealing band disposed around the tubular conduit and having an annular lip, the second sealing band disposed around the first sealing band and defining an angled channel with a tapered end of the cap, the annular lip of the first sealing band extending through the angled channel; and while transporting, capturing a portion of the fluid using the annular lip of the first sealing band.

Example 27. The method of example 26, wherein capturing the portion of the fluid comprises wiping an inner surface of the wellbore with the annular lip of the first sealing band.

Example 28. The method of example 26 or 27, comprising coupling a wireline adapter kit of a perforating string to the plug.

Example 29. The method of example 26 or any of examples 27-28, comprising:

moving a guide shoe of the plug along the tubular conduit from an unset position, away from cap, to a set position, toward the cap; and expanding the second sealing band outward from the tubular conduit in response to the guide shoe moving to the set position.

Example 30. The method of example 29, wherein moving the guide shoe comprises breaking a first frangible pin disposed at least partially within a first radially-aligned hole of the guide shoe.

Example 31. The method of example 29 or 30, comprising:

displacing a wireline adapter kit relative to the plug to break a second frangible pin disposed at least partially in a second radially-aligned hole of the guide shoe, the wireline adapter kit coupled to a perforating string.

Example 32. The method of example 29 or 30, comprising:

displacing a wireline adapter kit relative to the plug to break a second frangible pin disposed at least partially in a second radially-aligned hole of the guide shoe, the wireline adapter kit coupled to a perforating string; and receiving a plug body at the first end of the tubular conduit, the plug body configured to mate with a receiving surface of the first end, thereby occluding the tubular conduit.

Example 33. The method of example 29 or any of examples 30-32, comprising:

wherein the cap comprises an exterior surface configured to face upstream when the plug is disposed within the wellbore, the exterior surface having a notch formed therein; and wherein the method comprises:

receiving a leading-edge portion of a second plug in the notch of the exterior surface of the cap.

Example 34. The method of example 27 or 28, comprising:

moving a guide shoe of the plug along the tubular conduit from an unset position, away from cap, to a set position, toward the cap; and in response to the guide shoe moving to the set position:

expanding the second sealing band outward from the tubular conduit, and expanding a gripping assembly of the plug outward from the tubular conduit.

Example 35. The method of example 34, wherein the gripping assembly is disposed around the tubular conduit between the cap and the guide shoe and coupled to the guide shoe; and wherein the sealing assembly is disposed between the cap and the gripping assembly.

Example 36. The method of example 34 or 35, wherein moving the guide shoe comprises contacting the second end of the tubular conduit against an internal shoulder of the guide shoe when the guide shoe reaches the set position.

Example 37. The method of example 34 or any of examples 35-36, wherein moving the guide shoe comprises breaking a first frangible pin disposed at least partially within a first radially-aligned hole of the guide shoe.

Example 38. The method of example 34 or any of examples 35-37, comprising:

displacing a wireline adapter kit relative to the plug to break a second frangible pin disposed at least partially in a second radially-aligned hole of the guide shoe, the wireline adapter kit coupled to a perforating string.

Example 39. The method of example 34 or any of examples 35-37, comprising:

displacing a wireline adapter kit relative to the plug to break a second frangible pin disposed at least partially in a second radially-aligned hole of the guide shoe, the wireline adapter kit coupled to a perforating string; and receiving a plug body at the first end of the tubular conduit, the plug body configured to mate with a receiving surface of the first end, thereby occluding the tubular conduit.

Example 40. The method of example 34 or any of examples 35-39, comprising:

wherein the cap comprises an exterior surface configured to face upstream when the plug is disposed within the wellbore, the exterior surface having a notch formed therein; and wherein the method comprises:

receiving a leading-edge portion of a second plug in the notch of the exterior surface of the cap.

Example 41. The method of example 26 or any of examples 27-40, comprising de-coupling a wireline adapter kit of a perforating string from the plug.

While this specification contains many details, these should not be understood as limitations on the scope of what may be claimed, but rather as descriptions of features specific to particular examples. Certain features that are described in this specification or shown in the drawings in the context of separate implementations can also be combined. Conversely, various features that are described or shown in the context of a single implementation can also be implemented in multiple embodiments separately or in any suitable sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single product or packaged into multiple products.

A number of embodiments have been described. Nevertheless, it will be understood that various modifications can be made. Accordingly, other embodiments are within the scope of the following claims.

What is claimed is:

1. A plug for isolating a portion of a wellbore, the plug comprising:

a tubular conduit having a first end and a second end;

a cap disposed over the first end of the tubular conduit and coupled thereto, the cap configured to mate with a wireline adapter kit of a perforating string;

a guide shoe disposed over the second end of the tubular conduit and coupled thereto, the guide shoe configured to move along the tubular conduit from an unset position, away from a cap, to a set position, toward the cap;

a gripping assembly disposed around the tubular conduit between the cap and the guide shoe and coupled to the guide shoe, the gripping assembly configured to expand outward from the tubular conduit in response to the guide shoe moving into the set position; and a sealing assembly disposed between the cap and the gripping assembly and comprising:

a first sealing band disposed around the tubular conduit and having an annular lip, a second sealing band disposed around the first sealing band and defining an angled channel with a tapered end of the cap, the annular lip of the first sealing band extending through the angled channel, the second sealing band configured to expand outward from the tubular conduit in response to the guide shoe moving into the set position.

2. The plug of claim 1, wherein the first end of the tubular conduit comprises an interior bevel configured to seat a ball.

3. The plug of claim 1, wherein the cap comprises a through hole and a protrusion therein, the first end of the tubular conduit disposed against the protrusion.

4. The plug of claim 1, wherein the cap comprises an exterior surface configured to face upstream when the plug is disposed within the wellbore, the exterior surface having a notch formed therein.

5. The plug of claim 1, wherein the tapered end of the cap comprises:

a first tapered surface defining the angled channel with the second sealing band; and a second tapered surface supporting a portion of the annular lip that extends outside of the angled channel, the second tapered surface recessed relative to an outer circumferential surface of the cap.

6. The plug of claim 5, wherein an angled orientation of the second tapered surface is more shallow, relative to the outer circumferential surface of the cap, than an angled orientation of the first tapered surface.

7. The plug of claim 1, wherein an inward-facing surface of the second sealing band comprises a groove configured to seat a protrusion of an outward-facing surface of the first sealing band.

8. The plug of claim 1, wherein the gripping assembly comprises:

a conical ring having an outer beveled surface that tapers in a direction of the second end of the tubular conduit; and an expandable ring having an inner beveled surface configured to mate against the outer beveled surface of the conical ring.

9. The plug of claim 8, wherein the expandable ring comprises a plurality of tabs disposed circumferentially around the tubular conduit and configured to displace outward from the tubular conduit in response to the guide shoe moving into the set position.

10. The plug of claim 8, wherein the conical ring comprises an annular pocket for seating at least the second sealing band of the sealing assembly.

11. The plug of claim 8, wherein the tubular conduit comprises a raised portion between the first end and the second end, the raised portion bounded by a first shoulder facing the first end; and wherein the conical ring comprises a mating shoulder on an inner circumferential surface of the conical ring, the mating shoulder disposed against the first shoulder of the raised portion.

12. The plug of claim 1, wherein the guide shoe comprises:

a first portion having a first hole disposed along a longitudinal axis of the guide shoe;

a second portion having a second hole disposed along the longitudinal axis of the guide shoe, the second hole larger in diameter than the first hole and meeting the first hole at an internal shoulder; and wherein the second end of the tubular conduit is disposed within second hole, and when the guide shoe is in the unset position, the second end of the tubular conduit is offset from the internal shoulder, and when the guide shoe is in the set position, the second end of the tubular conduit is disposed against the internal shoulder.

13. The plug of claim 12, wherein the second portion of the guide shoe comprises a radially-aligned hole containing at least part of a frangible pin.

14. The plug of claim 12, wherein the first portion of the guide shoe comprises a radially-aligned hole containing at least part of a frangible pin.

15. The plug of claim 12, wherein the second portion of the guide shoe couples to the gripping assembly through a crown configured to interlock with a mating crown of the gripping assembly.

16. The plug of claim 12, wherein the second end of the tubular conduit couples to the second hole of the guide shoe through a ratcheting assembly.

17. A method of isolating a portion of a wellbore, the method comprising:

transporting a plug through the wellbore using a fluid, the plug comprising:

a tubular conduit having a first end and a second end, a cap disposed over the first end of the tubular conduit and coupled thereto, the cap configured to mate with a wireline adapter kit of a perforating string, a guide shoe, a gripping assembly disposed around the tubular conduit between the cap and the guide shoe and coupled to the guide shoe, and a sealing assembly disposed between the cap and the gripping assembly and having a first sealing band and a second sealing band, the first sealing band disposed around the tubular conduit and having an annular lip, the second sealing band disposed around the first sealing band and defining an angled channel with a tapered end of the cap, the annular lip of the first sealing band extending through the angled channel;

while transporting, capturing a portion of the fluid using the annular lip of the first sealing band;

moving the guide shoe of the plug along the tubular conduit from an unset position, away from the cap, to a set position, toward the cap; and in response to the guide shoe moving to the set position:

expanding the second sealing band outward from the tubular conduit, and expanding the gripping assembly of the plug outward from the tubular conduit.

18. The method of claim 17, wherein capturing the portion of the fluid comprises wiping an inner surface of the wellbore with the annular lip of the first sealing band.

19. The method of claim 17, wherein moving the guide shoe comprises breaking a first frangible pin disposed at least partially within a first radially-aligned hole of the guide shoe.

20. The method of claim 17, comprising:

coupling the plug to the wireline adapter kit of the perforating string; and displacing the wireline adapter kit relative to the plug to break a second frangible pin disposed at least partially in a second radially-aligned hole of the guide shoe, the wireline adapter kit coupled to a perforating string.

21. The method of claim 20, wherein coupling the plug comprises mating a surface of the cap against a surface of the wireline adapter kit.

22. The method of claim 17, comprising:

coupling the plug to the wireline adapter kit of the perforating string;

displacing the wireline adapter kit relative to the plug to break a second frangible pin disposed at least partially in a second radially-aligned hole of the guide shoe, the wireline adapter kit coupled to a perforating string; and receiving a plug body at the first end of the tubular conduit, the plug body configured to mate with a receiving surface of the first end, thereby occluding the tubular conduit.

23. The method of claim 22, wherein coupling the plug comprises mating a surface of the cap against a surface of the wireline adapter kit.

24. The method of claim 17, wherein moving the guide shoe comprises contacting the second end of the tubular conduit against an internal shoulder of the guide shoe when the guide shoe reaches the set position.

* * * * *